US006663348B2

(12) United States Patent
Schwarz et al.

(10) Patent No.: US 6,663,348 B2
(45) Date of Patent: Dec. 16, 2003

(54) METHOD OF CONTROLLING A COMPRESSOR, PISTON-POSITION MONITORING SYSTEM, AND COMPRESSOR

(75) Inventors: Marcos Guilherme Schwarz, Joinville-SC (BR); Paulo Sergio Dainez, Joinville-SC (BR)

(73) Assignee: Empresa Brasileira de Compressores S.A.-Embraco, Joinville-SC (BR)

( * ) Notice: Subject to any disclaimer, the term of this patent is extended or adjusted under 35 U.S.C. 154(b) by 0 days.

(21) Appl. No.: 10/178,068

(22) Filed: Jun. 21, 2002

(65) Prior Publication Data

US 2003/0021693 A1 Jan. 30, 2003

Related U.S. Application Data

(63) Continuation of application No. PCT/BR00/00145, filed on Dec. 22, 2000.

(30) Foreign Application Priority Data

Dec. 23, 1999 (BR) ..... 9907432

(51) Int. Cl.[7] ..... F04B 49/00

(52) U.S. Cl. ..... 417/12; 417/44.1; 417/44.11; 417/417

(58) Field of Search ..... 417/12, 44.1, 44.11, 417/417, 416

(56) References Cited

U.S. PATENT DOCUMENTS 4,602,174 A 7/1986 Redlich
5,342,176 A 8/1994 Redlich
5,450,521 A 9/1995 Redlich
5,496,153 A 3/1996 Redlich
5,592,073 A 1/1997 Redlich
5,704,771 A 1/1998 Fujisawa et al.
5,897,296 A * 4/1999 Yamamoto et al. ..... 417/44.1

FOREIGN PATENT DOCUMENTS

EP 0 909 896 A2 4/1999

OTHER PUBLICATIONS

Lilie et al. (US 2002/0038551 A1), Apr. 4, 2002, entire document.*
Yoo et al. (US 2002/0090304 A1, Jul. 11, 2002, entire document.*
Hwang et al. (US 2002/0150477 A1), Oct. 17, 2002, entire document.*
Nara et al. (US 2002/0028143 A1), Mar. 7, 2002, entire document.*
International Search Report, Apr. 10, 2001.

* cited by examiner

*Primary Examiner*—Cheryl J. Tyler
(74) *Attorney, Agent, or Firm*—Alston & Bird LLP

(57) ABSTRACT

A system and method for controlling a compressor (1) is provided that prevents the piston (5) of the compressor from colliding against the valve system (8, 9) provided therein. The system and method of the present invention control the stroke of the piston (5), allowing the piston (5) to advance as far as the end of its mechanical stroke in extreme conditions of load, without allowing the piston (5) to collide with the valve system (8,9). The present invention controls the compressor (1) by measuring a movement time of the piston (5); comparing the movement time with a foreseen movement time; and altering the voltage (Vm) if the first movement time is different from the foreseen movement time, the foreseen movement time being such that the movement of the piston (5) will reach a maximum point (M).

17 Claims, 4 Drawing Sheets

METHOD OF CONTROLLING A COMPRESSOR, PISTON-POSITION MONITORING SYSTEM, AND COMPRESSOR

CROSS-REFERENCE TO RELATED APPLICATIONS

This application is a Continuation of International Application PCT/BR00/00145 filed on Dec. 22, 2000, which designated the U.S. and was published under PCT Article 21(2) in English, which is hereby incorporated herein in its entirety by reference and which in turn, claims priority from Brazilian Application No. PI 9907432-0, filed on Dec. 23, 1999.

BACKGROUND OF THE INVENTION

The present invention refers to a method of controlling a compressor, particularly a method that prevents the piston from colliding against the valve system provided therein, as well as to a system of monitoring the position of a compressor piston, and the compressor equipped with a piston position monitoring system.

Linear-type compressors are known from the prior art and are composed of a mechanism in which the piston makes an oscillating movement and, in most cases, there is an elastic means interconnecting the cylinder and the piston, imparting a resonant characteristic to this movement, the energy being supplied by means of a linear displacement motor.

In a known solution A—U.S. Pat. No. 5,704,771—Sawafuji Electric), the stroke of the piston is primordially proportional to the level of voltage applied to the linear motor, which is of the fixed-magnet-and-moveable-coil type. In this solution the mechanism is built in such a way, that the relationship between the extent of the stroke and the diameter of the piston is large, such that the variation of the end position reached by the piston during its oscillating movement, due to variations in feed voltage and load, does not interfere significantly with the characteristics of efficiency and capacity of cooling the compressor.

In this solution the mechanism is provided with a discharge valve built in such a way that, if the piston exceeds the maximum stroke expected in its oscillating movement, for instance when the voltage applied to the motor is excessive, the piston will contact the discharge valve, and the latter will allow for some advance of the piston, thus preventing an impact against the valve-head plate.

In another known solution, the stroke of the piston is also primordially proportional to the voltage applied to the linear motor, which is of the "moveable magnet and fixed coil" type (B—U.S. Pat. No 4,602,174—Sunpower, Inc.)

In this solution the design of the mechanism does not have a mechanical limiter for the piston stroke and is not sized to bear the excess shock of the piston against the valve plate. Due to the search for a design that is more optimized in efficiency, the relationship between the stroke and the diameter of the piston is not great, which makes the performance of the compressor more dependent upon variations in the piston stroke. As an example, the process of discharging the gas takes place in a very small portion of the stroke, about 5% of the total.

Another effect that occurs in this type of compressor is the displacement of the medium point of the oscillating movement, having the effect of displacing the piston away from the discharge valve. This is due to the elastic deformation of the resonant mechanical system formed by the piston and a spring, when there is difference in pressure between the two sides of the piston. This displacement of the medium point of the oscillating movement is proportional to the difference in pressure between the discharge and suction.

For the above reasons, in this solution, it is necessary to use a controller to control the piston stroke. The controller controls the voltage applied to the linear motor based on re-fed information concerning piston position, basically estimated from the information of current supplied to the motor and the voltage induced in the terminals of the motor (C—U.S. Pat. Nos. 5,342,176, 5,496,153, 5,450,521, 5,592,073).

Another procedure employed for providing re-feed to this voltage controller is to observe if the shock of the piston against the valve plate, detected by means of a shock-detecting microphone or an acceleration meter (solution D), which generates a command for reduction of the voltage applied to the motor and, consequently, of the piston stroke.

In solution (A) the piston stroke is not controlled, and the design can allow variations in voltage and load, without any damage to the mechanism, but this brings limitation of efficiency to the product. In this solution too, the possible shocks of the piston against the discharge valve, even if not impairing the reliability of the product, entail an increase in noise.

In solution (C), the piston stroke is controlled by taking as a reference the estimated position of the piston, calculated from the current and voltage at the terminals of the motor, but this experiences errors due to the constructive variations of the motor, variations in temperature and in load, thus hindering a more precise control, which limits the efficiency and the operation in extreme conditions of cooling capacity.

Another drawback of this solution is that calculation of the displacement of the medium point of the oscillating movement becomes imprecise, which is basically caused by the average difference between the suction pressure and the discharge pressure and the elastic constant of the spring of the resonant system.

In solution (D) the maximum piston stroke is controlled by maintaining the voltage applied to the motor at a level right below that which causes collision, which is achieved by detecting collisions and, on the basis of the information obtained, reducing the applied voltage slightly.

The drawbacks of this solution are the collisions themselves, which are necessary for informing the proximity of the piston to the valve plate, since they cause noise and some mechanical damage, which reduces the useful life of the product.

Another disadvantage is the relatively slow reaction of this form of control, which is generally incapable of preventing collisions and reductions in the cooling capacity during periods in which there are sharp oscillations in feed voltage, that occurs often in the public electric power network.

These limitations in the more precise control of the piston stroke represent a great limitation of performance for this type of compressor. The ideal situation would be to allow the piston to come as close as possible to the valve plate, without a collision occurring. The controls known from the prior art do not permit this approximation, because there is no precision in estimating the position of the piston, and it is necessary to maintain a longer security distance, which leads the compressor not to pump gas when the discharge pressure is high, and reduces the maximum possible efficiency due to the dead volume.

BRIEF SUMMARY OF THE INVENTION

The objectives of the present invention are:

to control the stroke of piston of a linear compressor, allowing the piston to advance as far as the end of its mechanical stroke, even in extreme conditions of load, without allowing the piston to collide with the valve system.

to control the stroke of the piston of a linear compressor, allowing the piston to advance as far as the end of its mechanical stroke, even in extreme conditions of load, without allowing the piston to collide against the valve system, even in the presence of extreme disturbances from the energy supply network;

to provide control over the stroke of the piston of a linear compressor, without the need for information on the displacement of the medium point of piston oscillation;

to provide control over the amplitude of the oscillation stroke of a linear compressor, permitting control over the cooling capacity developed by the compressor.

These objectives are achieved by means of a method of controlling a compressor, particularly a linear compressor, which comprises a piston and a linear motor, the piston moving along a stroke and being driven by the motor, an average voltage being applied to the motor and controlling the movement of the piston, the method comprising the steps of measuring a first movement time of the piston; comparing the first movement time with a foreseen movement time; altering the voltage if the first movement time is different from the foreseen movement time, the foreseen movement time being such that the movement of the piston will reach a maximum point.

A system for monitoring the position of the piston of a compressor is also foreseen, with a view to preventing the piston from colliding against the valve plate located at the end of the piston stroke. This objective is achieved by a system of monitoring the position of a piston, particularly a piston of a linear compressor, the piston moving along a stroke and being driven by a motor, the motor being driven by a voltage, the system comprising an electronic circuit monitoring the movement of the piston from the passage at a reference point, the reference point being located at a position farther from the end of the stroke of the piston than a maximum point, the electronic circuit measuring a permanence time that the piston remains beyond the reference point and comparing the permanence time with a desired foreseen time, the desired foreseen time being shorter or equal to a maximum stroke time of maximum stroke when the piston reaches the maximum point, the electronic circuit decreasing the voltage if the permanence time is longer than the desired foreseen time, and increasing the voltage if the permanence time is shorter than the desired foreseen time.

It is also an objective of the present invention to provide a compressor having a monitoring system that prevents the piston from advancing as far as the end of its mechanical stroke, even in extreme conditions of load, without allowing the piston to collide against the valve system. This objective is achieved by means of a compressor, particularly a linear compressor, that comprises a piston, a valve plate and a linear motor, the piston moving along a stroke and being driven by the motor, the compressor comprises an electronic circuit measuring a permanence time that the piston remains beyond a reference point and comparing the permanence time with a desired foreseen time, the desired foreseen time being shorter or equal to a maximum stroke time of maximum stroke when the piston reaches a maximum point, the reference point being located at a position farther from the valve plate than the maximum point.

BRIEF DESCRIPTION OF THE DRAWINGS

The present invention will now be described in greater detail with reference to an embodiment represented in the drawings. The figures show.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
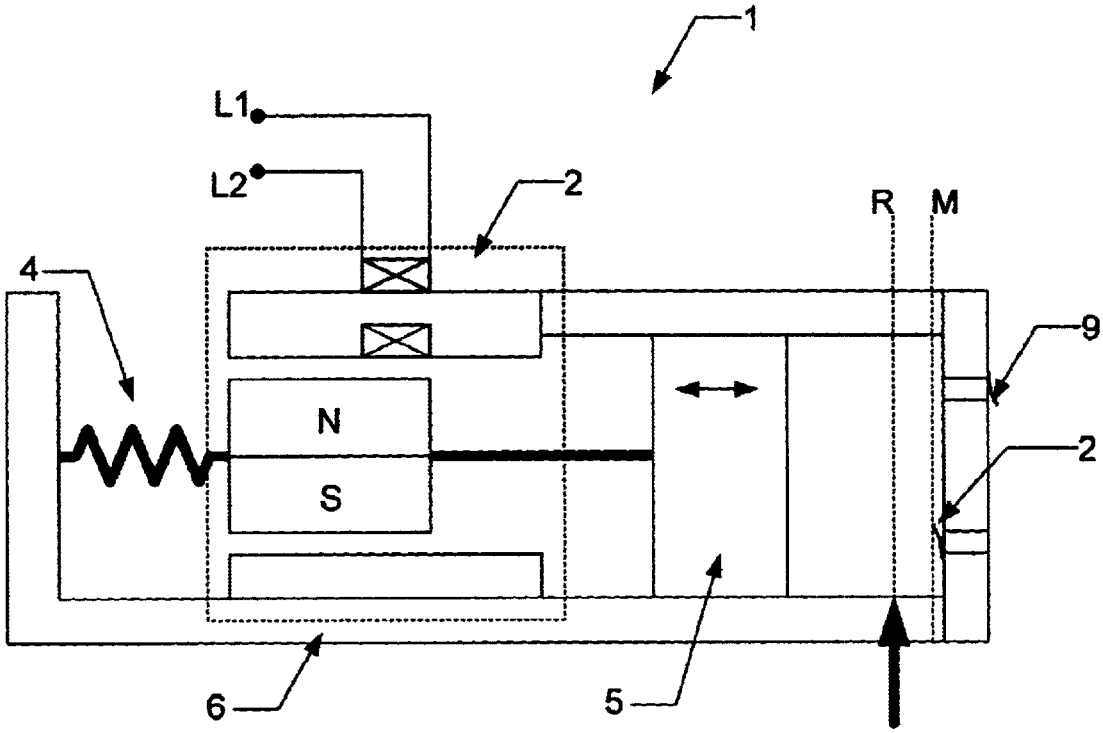
FIG. 1—a schematic view of a linear compressor, where the method of the present invention is applied.

FIG. 1 schematically illustrates a linear-type compressor 1, which is provided with a piston 5 housed within a block 6, where its stroke and movement are defined, and is driven by a linear motor 2. The piston 5 makes an oscillating movement of the resonant kind by action of a spring 4, the control of its movement being effected by means of an electronic circuit 40, (FIG. 3), which includes an inverter 50, (FIG. 5), and a microcontroller 41, (FIG. 6), the inverter 50 being capable of altering the amplitude of the piston stroke. Close to the end of the piston stroke there is a valve plate 8,9, against which the piston 5 may collide in the event of an external disturbance that causes alteration in the movement of said piston 5.

Figure 2:
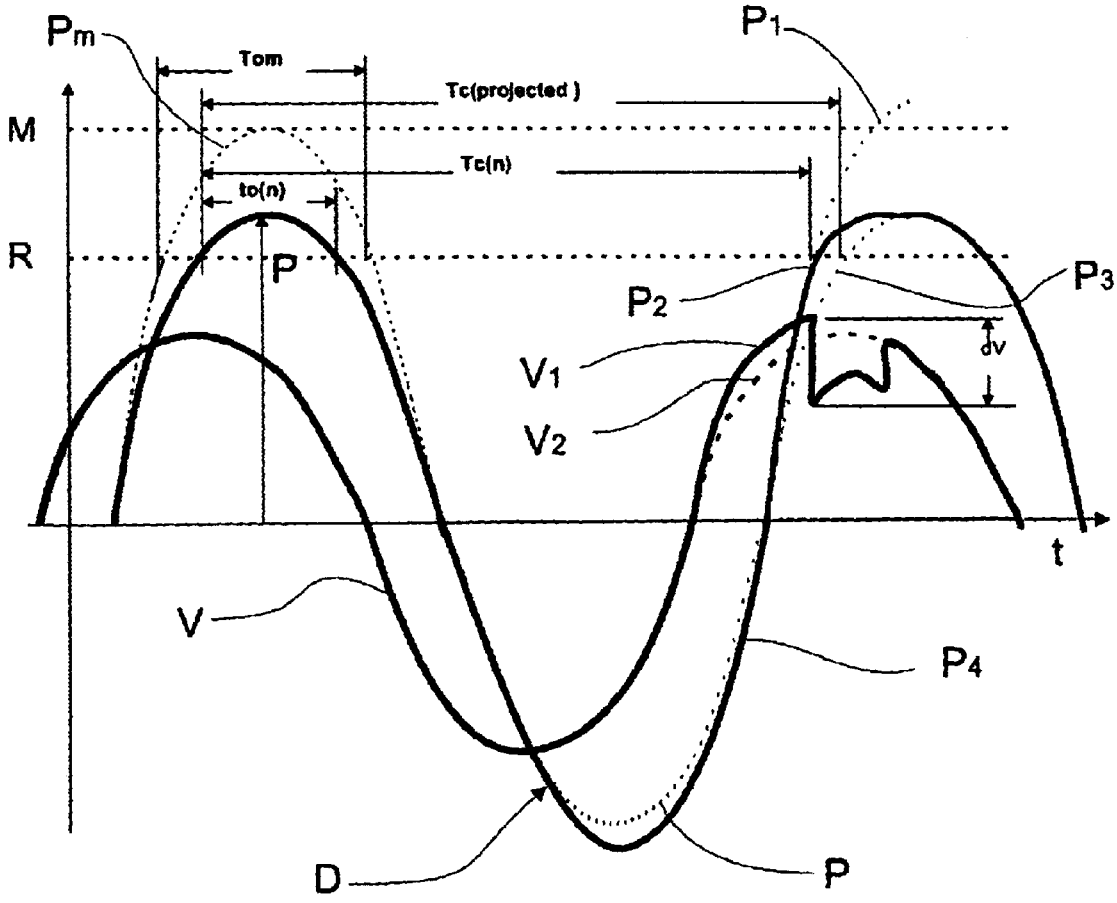
FIG. 2—the behavior of the piston of the compressor illustrated in FIG. 1, and the behavior of the electric voltage applied to the motor that controls it.
Figure 3:
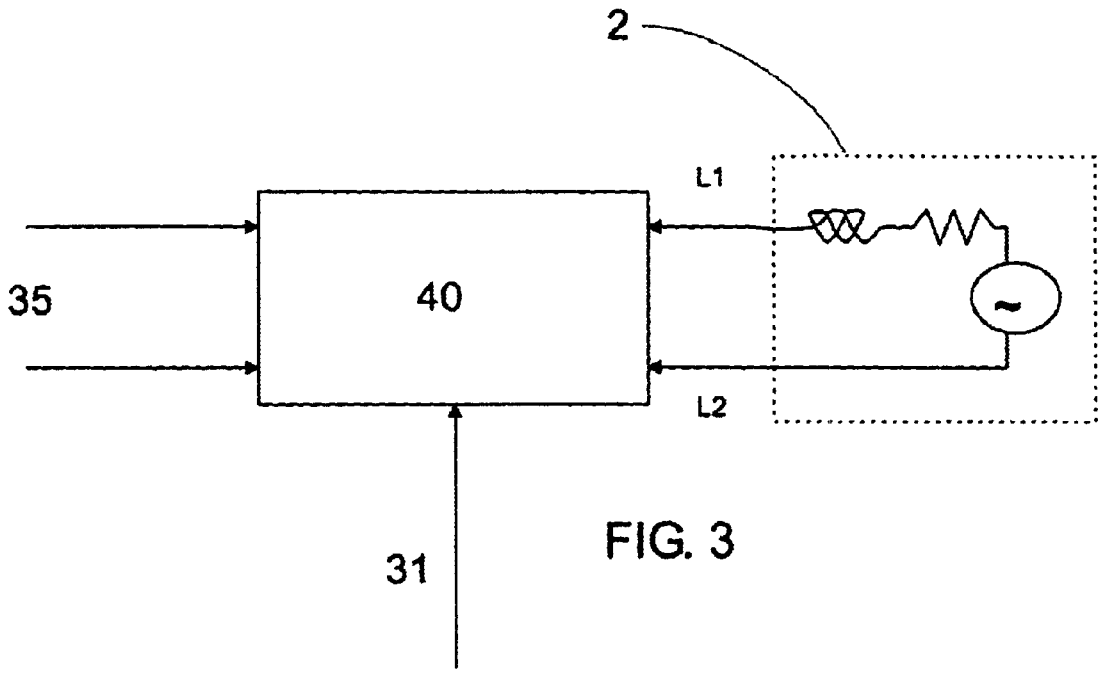
FIG. 3—a block diagram of the method of the present invention.

Control and alteration in amplitude are effected by means of re-feed 31, which is measured at a reference point "R" physically defined within the block 6 along the stroke of the piston 5, as shown in FIG. 3. Specifically, the objective of the present invention uses information of the permanence time "to" (or time of movement) of the piston 5 beyond the reference point "R" close to the end of the maximum possible stroke "M" (or maximum point "M") for the piston 5, duration time of a complete cycle "tc" (or cycle time), and information of the time "tom" (or maximum stroke time "tom") corresponding to the maximum point "M" for the piston 5 illustrated by means of the curve "Pm" in FIG. 2, the average voltage "Vm" applied to the motor being incremented in case the permanence time "to" is shorter than a desired foreseen time time "tod" and vice-versa, maintaining the desired displacement "P" to supply a determined cooling capacity of the system where the compressor 1 is employed.

The permanence time "to" of the piston 5 is the average of the last measurements of the permanence times "to(n)", "to(n−1)", . . . , and the desired foreseen time "tod" (or foreseen movement time) corresponds to the remain time of the piston 5 beyond the reference point "R" for the desired stroke "P", shorter than maximum point "M". This desired stroke "P" is defined by the demand for refrigeration by the system.

In addition to the control over the average voltage "Vm", the difference in time between the time cycle time "tc" (or movement time) of passage by the piston at the reference point "R" and the moment "tc(projected)" (or foreseen projected time) expected for this passage by the reference point "R", defined as being the average duration of the previous cycles "tc(n)", "tc(n−1)", . . . , enables one to impose a correction "dV" on the voltage "V1" applied to the motor, which is different from the desired voltage "V2", during the cycle in course. Specifically, during the period in which the piston 5 passes by the reference point "R" and the expected moment for passage by the point of maximum amplitude "P" and thus seeking to correct the path in that cycle, maintaining the stroke "P2" very close to the desired value "P3" and preventing the piston 5 from colliding against the valve plate 8,9, which would occur if the path of the piston 5 continued as illustrated in the curve "P1" and "P4" from the beginning of the disturbance "D" in FIG. 2.

The maximum point "M" is very close to the valve plate 8,9, typically remaining at a distance of a few dozens of micrometers.

The reference point "R" is located close to the valve plate 8,9, typically remaining at a distance of 1–2 millimeters.

By way of example, considering a compressor 1 with resonance frequency of 50 Hz and piston 5 stroke on the order of 16 mm, positioning the reference point "R" at about 2 mm from the valve plate 8,9, we have a permanence time "to" that varies from zero to a maximum stroke time "tom" of about 3.9 ms, depending upon the refrigeration capacity required. The foreseen projected time "tc(projected)" would be of 20 ms (1/50 Hz), and the time cycle time "tc(n)" typically varying 5% with respect to the foreseen projected time "tc(projected)." This range of 5% is a consequence of disturbances in the feed network 35.

The measurement of these times is typically carried out by using a temporizer, which can physically be a "timer" existing in a microcontroller 41. In the measurement of the permanence time "to", for instance, when the logical level from the sensor 10 installed at the reference point "R" passes from 0 to 1, indicating that the piston 5 is in the region beyond the reference point "R", one begins the measurement of the permanence time "to", which ends when the sensor 10 informs that the piston 5 has returned to a position on this side of the reference point "R", characterized by the passage of the logical level from 1 to 0. In the same way, a second temporizer will measure the time passed between the moment when the piston 5 advanced beyond the reference point "R" in the present cycle and the moment when the piston 5 passes by this point again in the following cycle, resulting in the cycle time "tc(n)".

The desired foreseen time "tod" should be defined according to the cooling capacity required, and there is a maximum permissible value for the desired foreseen time "tod," which corresponds to the maximum stroke time "tom" when the piston 5 is at its maximum stroke. The longer the desired foreseen time "tod" the greater the cooling capacity, and a corresponding table between the cooling capacity and the value of the desired foreseen time "tod" should be defined for each model of compressor. The desired foreseen time "tod" may also be expressed as a portion "k" of the maximum stroke time "tom", for example tod=K*tom. The desired foreseen time "tod" varies according to the need and ranges from zero to a value equal to the maximum stroke time "tom", and so the portion "k" varying from 0 to 1.

The method of the present invention, as well as the system of monitoring the piston 5, enables one to estimate, at each cycle, the oscillation amplitude of the piston 5 with much greater precision, permitting reaction of the electronic control to compensate variations in the cooling capacity, which are slow variations, maintaining the average amplitude of the oscillation stroke of the piston 5 at the desired value equal to "P", and also permitting rapid reactions of the electronic control for counterbalancing sharp variations in the operational conditions, caused by fluctuations in the feed voltage 35, and these corrections should be imposed at each oscillation cycle, so as to correct the amplitude of the stroke of the piston 5 at the final part of its path, after passing by the physical reference point "R".

In the cases of sharp elevation of the voltage, the correction of the stroke is made by increasing or decreasing the value of voltage "V" and, consequently, of the tension "Vm" applied to the motor at a value "dV" proportional to the difference between the cycle time "tc(n)" and the foreseen projected time "tc(projected)".

When the demand of the compressor 1 varies, or when slow alterations in the electricity feed network occur, the average voltage "Vm" applied to the motor is changed if the permanence time "to" that the piston 5 remains beyond the reference point "R" is different from a desired foreseen time "tod", increasing the average voltage "Vm" if the permanence time "to" is shorter than the desired foreseen time "tod" and decreasing the average voltage "Vm" applied if the permanence time "to" is longer than the desired foreseen time "tod".

Figure 5:
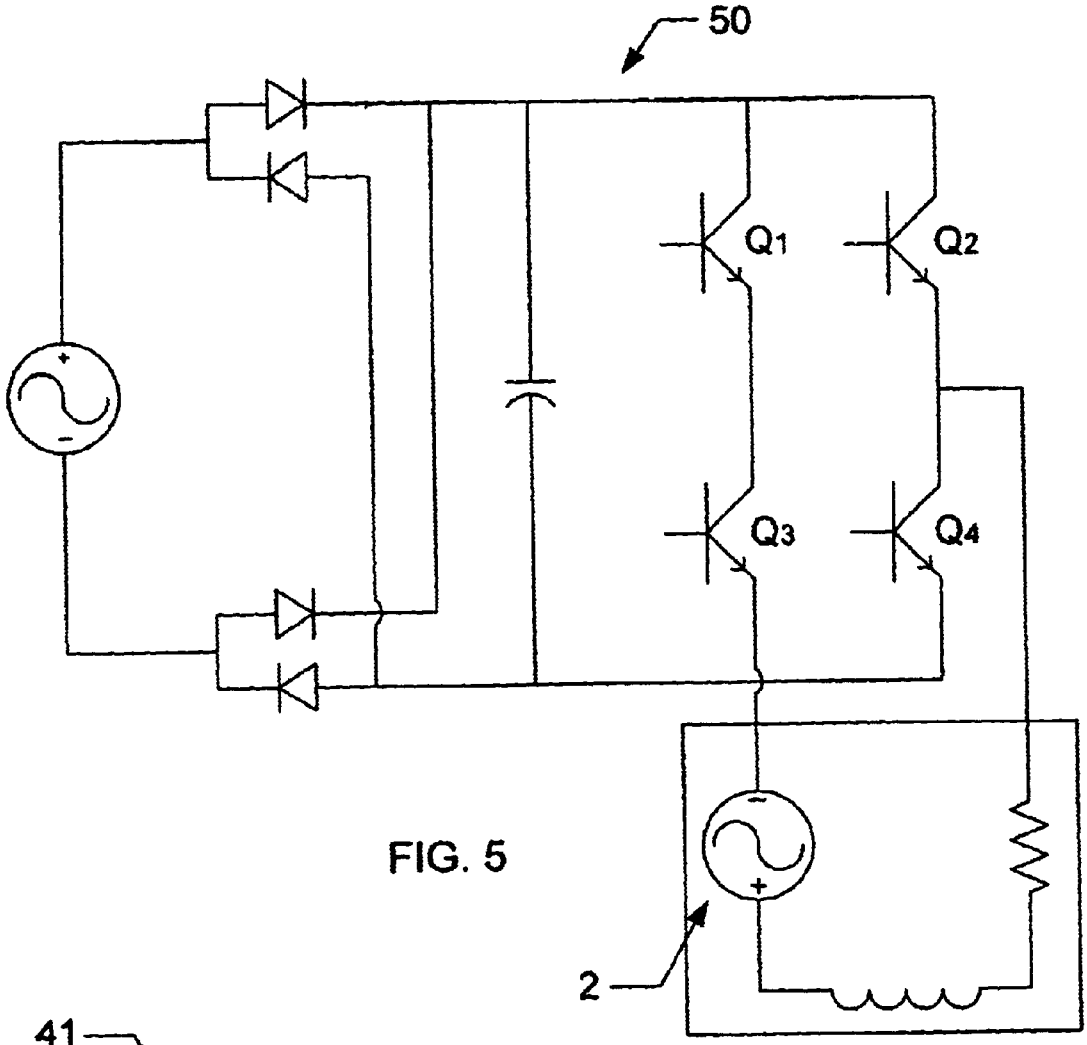
FIG. 5—a schematic diagram of the inverter that controls the motor.
Figure 6:
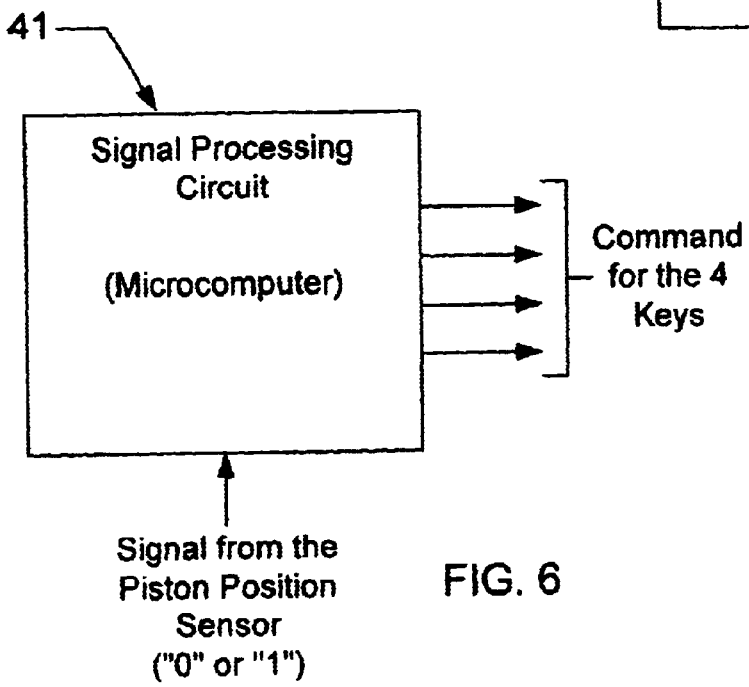
FIG. 6—a block diagram showing how the sensor actuates on the inverter by means of a microcomputer.

As can be seen from FIGS. 5 and 6, the electronic circuit 40, which includes the inverter 50, controls the motor 2 by means of the value "Vm", receives a re-feed 31 from a sensor 10 installed inside the compressor 1, thus controlling the movement of the piston 5.

A preferred way of raising and lowering the value of "Vm" is by employing PWM-type modulation, which applies, by controlling the keys Q1, Q2, Q3, Q4, a variable (and controllable) voltage value to the terminals of the linear motor 2 for varying the work cycle of this modulation. Typically, a frequency of about 5 kHz is used for this PWM modulation of the voltage on the motor 2. An embodiment example of this type of circuit is illustrated in FIG. 5.

In order to carry out the control of value "dV", one changes the PWM cycle, which, for few modulation cycles, may pass abruptly from a "work cycle" of 80% to 50%, for example, during this variation for a few milliseconds, only to ensure correction of the piston stroke after a sharp disturbance coming from the feed network.

The control of the inverter 50 is carried out by means of the sensor 10, which actuates by triggering temporizers that measure the permanence times "to(n)" and the cycle time "tc(n)". The calculations of the average value of the last cycles and the other calculations of comparisons between the times measured with the maximum stroke times "tom" and foreseen projected times "tc(projected)" stored therein will be carried out by the microcontroller 41. The result of these calculations is the value of the cycle of application of the voltage "Vm" to the motor 2 to obtain the required cooling capacity. The result of these calculations is also the sharp and temporary variation of this cycle of PWM voltage application, temporarily correcting the voltage "dV" to compensate sharp changes in voltage, as for example, transients from turning off a motor connected to a near point of the electric network 35.

The method and system and, consequently, the compressor 1, have as advantages rapid reaction, corrections at each cycle, without the need for estimates based on the voltage and current applied to the motor 2 and free from errors due to secondary variations such as temperature, construction of the motor 2 and displacement of the medium point of oscillation of the piston 5 due to the average difference in pressure between the faces of the piston 5. It also enables one to implement a control that effectively maintains control over the piston 5 stroke, independently of the required cooling capacity, and capable of preventing mechanical collision of the piston 5 against the valve plate 8,9, even in the presence of rapid disturbances caused by the natural fluctuation of the voltage in the commercial network of electric energy 35.

Figure 4:
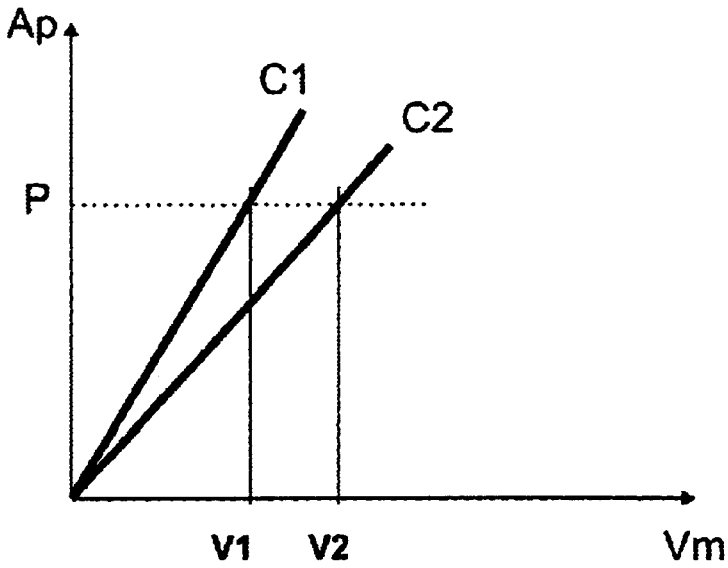
FIG. 4—a graph illustrating the correlation between the displacement of the piston and the voltage applied to the linear motor.

As illustrated by way of example in FIG. 4, a voltage V1 lower than a voltage V2 is necessary to achieve the same amplitude of the piston 5, when a load C2 is greater than C1, respectively.

Detection of the passage of the piston 5 by the physical reference point "R" may be effected by means of a physical sensor 10 installed inside the compressor 1, of the contact type, optical type, inductive type or an equivalent one. This detection may also be effected by adding a magnetic disturbance added to the voltage present at the terminals of the motor 2, this disturbance being created by a constructive detail of the magnetic circuit of the motor, for example.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of controlling a compressor (1), which comprises a piston (5) and a linear motor (2), the piston (5) moving along a stroke and being driven by the motor (2), an average voltage (Vm) being applied to the motor (2) and controlling the movement of the piston (5), the method comprising the steps of:

measuring a movement time of the piston (5);

comparing the measured movement time with a foreseen movement time; and altering the voltage (Vm) if the measured movement time is different from the foreseen movement time, the foreseen movement time being the time for the movement of the piston (5) to reach a maximum point (M).

2. A method according to claim 1, wherein the measured movement time is a permanence time (to) that the piston (5) remains beyond a reference point (R) located at a position along the stroke of the piston (5), the reference point (R) being located at a position farther from an end of the stroke of the piston (5) than the maximum point (M), the foreseen movement time being a desired foreseen time (tod), the method further comprising steps of:

decreasing the voltage (Vm) if the permanence time (to) is longer than the desired foreseen time (tod), the desired foreseen time (tod) being a time not greater than a maximum stroke time (tom), the maximum stroke time (tom) being a duration of time of when the piston (5) reaches the maximum point (M); and increasing the voltage (Vm) if the permanence time (to) is shorter than the desired foreseen time (tod).

3. A method according to claim 2, wherein the maximum stroke time (tom) is shorter than the duration of time passed between a first and a second passage of the piston (5) by the reference point (R) when the piston (5) reaches the end of the stroke.

4. A method according to claim 3, wherein the first passage of the piston (5) by the reference point (R) occurs when the piston moves towards the end of the piston stroke, and the second passage of the piston (5) occurs when the piston moves in the opposite direction away from the end of the piston stroke and in a movement following that occurred at the moment of the first passage.

5. A method according to claim 1, wherein the movement time is a cycle time (tc(n)) of duration of the movement of a complete piston cycle, the foreseen movement time is a foreseen projected time (tc(projected)), said comparing step comparing the cycle time (tc(n)) with the foreseen projected time (tc(projected)), the foreseen projected time (tc (projected)) being an expected duration of time of the passage of the piston (5) by a reference point (R) and having a minimum value that prevents collision of the piston (5) at the end of the stroke, the reference point (R) being located at a point farther from the end of the piston (5) stroke than the maximum point (M), said altering step decreasing the voltage (Vm) if the cycle time (tc(n)) is shorter than the foreseen projected time (tc(projected)).

6. A method according to claim 5, wherein said altering step decreases the voltage (Vm) when the piston (5) is beyond the reference point (R).

7. A method according to claim 6, wherein said altering step alters the voltage (Vm) by a value (dV) applied to a voltage (V), the value (dV) being proportional to the difference between the cycle time (tc(n)) and the foreseen projected time (tc(projected)).

8. A method according to claim 1 further comprising the step of measuring the position of the piston (5) at the reference point (R).

9. A system of monitoring the position of a piston (5), the piston (5) moving along a stroke and being driven by a motor (2), the motor (2) being driven by a voltage (Vm), the system comprising an electronic circuit (40) monitoring the movement of the piston (5) from the passage at a reference point (R), the reference point (R) being located at a position farther from the end of the stroke of the piston (5) than a maximum point (M), the electronic circuit (40) measuring a permanence time (to) that the piston (5) remains beyond the reference point (R) and comparing the permanence time (to) with a desired foreseen time (tod), the desired foreseen time (tod) being no greater than a maximum stroke time (tom) of maximum stroke when the piston (5) reaches the maximum point (M), the electronic circuit (40) decreasing the voltage (Vm) if the permanence time (to) is longer than the desired foreseen time (tod), and increasing the voltage (Vm) if the permanence time (to) is shorter than the desired foreseen time (tod).

10. A system according to claim 9, wherein said electronic circuit (40) measures a cycle time (tc(n)) of duration of the movement of a complete cycle of the piston (5), and compares the cycle time (tc(n)) with a foreseen projected time (tc(projected)), the foreseen projected time (tc (projected)) being an expected moment of passage of the piston (5) by the reference point (R), the system decreasing the voltage (Vm) if the cycle time (tc(n)) is shorter than the foreseen projected time (tc(projected)).

11. A system according to claim 10, wherein the reference point (R) is located at a position farther from the end of the stroke of the piston (5) than the maximum point (M).

12. A system according to claim 11, wherein said electronic circuit (40) comprises a microcontroller (41) and an inverter (50), wherein said microcontroller (41) measures the permanence time (to) and cycle time (tc(n)), and said inverter (50) alters the voltage (Vm).

13. A compressor (1) that comprises:

a piston (5), a valve plate (8,9) and a linear motor (2), the piston (5) moving along a stroke and being driven by the motor (2), said compressor (1) further comprising:

an electronic circuit (40) measuring a permanence time (to) that the piston (5) remains beyond a reference point (R) and comparing the permanence time (to) with a desired foreseen time (tod), the desired foreseen time (tod) being no greater than a maximum stroke time (tom) of maximum stroke when the piston (5) reaches a maximum point (M), the reference point (R) being located at a position farther from the a valve plate (8,9) than the maximum point (M).

14. A compressor according to claim 13, wherein the electronic circuit (40) decreases the voltage (Vm) if the permanence time (to) is longer than the desired foreseen time (tod), and increases the voltage (Vm) if the permanence time (to) is shorter than the desired foreseen time (tod).

15. A compressor according to claim 14, wherein the electronic circuit (40) measures a cycle time (tc(n)) of duration of the movement of a complete cycle of the piston (5), and compares the cycle time (tc(n)) with a foreseen projected time (tc(projected)), the projected time (tc (projected)) being an expected moment of passage of the piston (5) by the reference point (R), the electronic circuit (40) decreases the voltage (Vm) if the cycle time (tc(n)) is shorter than the projected time (tc(projected)).

16. A compressor according to claim 14 wherein the electronic circuit (40) comprises a first controller (41) and an inverter (50), wherein the microcontroller (41) measures the permanence time (to) and cycle time (tc(n)), and wherein the inverter (50) alters the voltage (Vm).

17. A compressor according to claim 15 wherein the permanence time (to) and the cycle time (tc(n)) is an average of multiple measures.

* * * * *